US007374448B1

(12) United States Patent
Jepsen et al.

(10) Patent No.: US 7,374,448 B1
(45) Date of Patent: May 20, 2008

(54) ELECTRICAL CONNECTOR LOCKING SYSTEM

(75) Inventors: David L Jepsen, Kennewick, WA (US); Christopher Lisle Bolkan, Pasco, WA (US); Richard A Villarreal, West Richland, WA (US); Arlee Clayton Swensen, West Richland, WA (US)

(73) Assignee: Cadwell Laboratories, Inc., Kennewick, WA (US)

( * ) Notice: Subject to any disclaimer, the term of this patent is extended or adjusted under 35 U.S.C. 154(b) by 0 days.

(21) Appl. No.: 11/592,378

(22) Filed: Nov. 3, 2006

(51) Int. Cl.
*H01R 13/62* (2006.01)

(52) U.S. Cl. ..... 439/350; 439/357

(58) Field of Classification Search ..... 439/350, 439/357
See application file for complete search history.

(56) References Cited

U.S. PATENT DOCUMENTS 4,568,135 A * 2/1986 Frantz ..... 439/350
4,597,620 A * 7/1986 Lindner et al. ..... 439/277
4,735,583 A * 4/1988 Rudy et al. ..... 439/350
4,889,502 A 12/1989 Althouse et al.
5,176,533 A * 1/1993 Sakurai et al. ..... 439/352
5,462,448 A 10/1995 Kida et al.
5,775,931 A 7/1998 Jones
5,933,929 A 8/1999 Kawakami et al.
6,033,250 A * 3/2000 Pauza ..... 439/357
6,088,878 A 7/2000 Antonucci et al.
6,109,948 A 8/2000 Kuo
6,116,941 A 9/2000 Kuo
6,119,306 A 9/2000 Antonucci et al.
6,210,202 B1 4/2001 Kuo
6,241,548 B1 6/2001 Kuo
6,264,491 B1 7/2001 Lord
6,273,740 B1 8/2001 Lord
6,579,114 B2 6/2003 Lord
6,799,931 B2 10/2004 Kwilosz
6,837,716 B1 1/2005 Brazas
6,869,301 B2 3/2005 Shimizu et al.
2002/0009916 A1 1/2002 Lord
2002/0088098 A1 7/2002 Bouley
2003/0236018 A1 * 12/2003 Mimoto et al. ..... 439/357
2004/0192100 A1 9/2004 Shimizu et al.
2005/0003682 A1 1/2005 Brazas

* cited by examiner

*Primary Examiner*—Gary F. Paumen
(74) *Attorney, Agent, or Firm*—Christensen O'Connor Johnson Kindness PLLC

(57) ABSTRACT

A locking mechanism for electrical connectors is disclosed. The locking mechanism comprises one or more sockets affixed to one of a pair of electrical connectors, e.g., a male electrical connector, and one or more mating studs affixed to the other of the pair of electrical connectors, e.g., a female electrical connector. The sockets lockingly engage the studs when the pair of electrical connectors are connected. The sockets are affixed to the male electrical by ribs, which form part of elongate socket fittings that also include the sockets, and socket fitting retainers. The studs are affixed to the female electrical connector by threads.

16 Claims, 5 Drawing Sheets

ELECTRICAL CONNECTOR LOCKING SYSTEM

BACKGROUND

Electrical connectors are often connected in an environment in which external forces can unintentionally loosen, or completely disengage, the connectors. Accordingly, it is often desirable that electrical connectors include a locking system that prevents unintentional disengagement.

One common electrical connection environment where a locking system is highly desirable is serial or other cable connections to computing devices, such as desktop and laptop computers. FIG. 1 is an example of a prior art electrical connector assembly designed for use in such an environment. More specifically, FIG. 1 shows a standard D-type serial cable type electrical connector assembly 101 that includes a male connector 110, a female connector 120, and a locking system. The male connector 110 is attached to the end of an electrical cable 115, and includes a plurality of male elements 111 located in a housing 114. The female connector 120 comprises a plurality of mating female elements 119 located in a housing 121 mounted in the chassis of an electronic device 123.

Still referring to FIG. 1, the locking system comprises a pair of thumbscrews 112 and a pair of jack-sockets 122. The thumbscrews are located at opposite ends of the male connector housing 114. Each thumbscrew 112 has a threaded portion and is disposed within a hole 113 in the male connector housing 114 such that the threaded portion of the thumbscrew 112 protrudes from the housing 114. The jack-sockets 122 are located at opposite ends of the female connector housing 121. The jack-sockets are threaded and positioned so that each jack-socket 122 is able to receive the threaded portion of one of the thumbscrews 112 when the male connector 110 is attached to the female connector 120. In order to lock the first connector 110 to the second connector 120, each thumbscrew 112 of the male connector is rotated until the threaded portion of the thumbscrew 112 fully engages the corresponding jack-socket 122 of the female connector 120.

While a locking system that includes thumbscrews 112 and jack-sockets 122 adequately secures a male connector 110 to a female connector 120 in a standard electrical connector assembly 101, this system has several disadvantages. For example, screwing and unscrewing the thumbscrews 112 can be tedious and time-consuming, especially when multiple connectors must be engaged or disengaged, or when one or more connectors need to be engaged and disengaged multiple times. It can also be difficult to engage and disengage the connectors when access to the thumbscrews is limited due to close proximity to other connectors, or by limited access to the connection.

SUMMARY

This following summary is provided to introduce a selection of concepts in a simplified form that are further described below in the Detailed Description. This summary is not intended to identify key features of the claimed subject matter, nor is it intended to be used as an aid in determining the scope of the claimed subject matter.

A fast, easy locking system for electrical connectors is disclosed. The locking system includes socket fittings mounted on one of the electrical connector, i.e., the male connector, and mating studs mounted on the other electrical connector, i.e., the female connector. When the elements of the male connector engage the elements of the female connector, the socket fittings snap onto the studs to create a secure (locked) connection. Preferably, the stud includes a lock portion that passes through an aperture in the socket to lockingly engage a cavity in the socket. Also preferably, the connectors are disengaged by creating a slight lateral movement while pulling the connectors apart, thereby breaking the grip of the sockets on the studs one at a time.

The electrical connector locking system can be installed on a standard electrical connector assembly to replace a thumbscrew and jack-socket locking system. The standard thumbscrew and jack-socket locking system is removed, and one of these elements is replaced with a socket and the other with a mating stud.

DESCRIPTION OF THE DRAWINGS

The foregoing aspects and many of the attendant advantages thereof will become better understood by reference to the following detailed description when taken in conjunction with the accompanying drawings, wherein.

DETAILED DESCRIPTION

Figure 2:
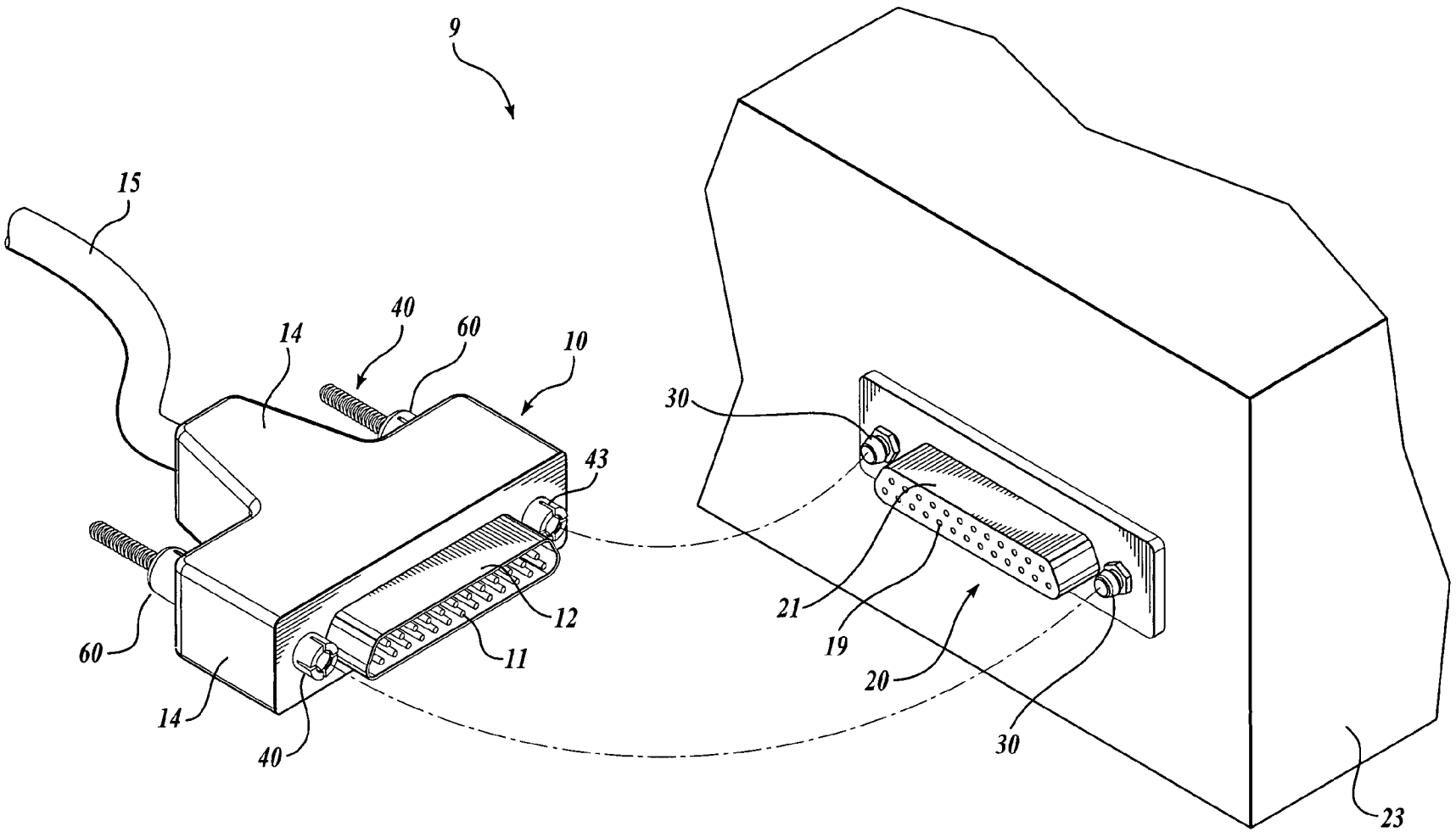
FIG. 2 is an exploded view of a connector assembly including an exemplary embodiment of the disclosed locking system.

An exemplary embodiment of the electrical connector locking system is described herein with reference to the accompanying illustrations where like numerals correspond to like elements is illustrated in FIGS. 2-7. More specifically, FIG. 2 illustrates an electrical connector assembly 9 suitable for connecting an electrical cable 15, such as a serial cable, to a device 23. The device 23 can be a computing device, such as a desktop or laptop personal computer (PC), a computer peripheral device, such as a monitor or printer, or, more generally, any electronic component device that requires an electrical connection to an electrical cable 15. The other end of the electrical cable 15 is connectable to another device or devices (not shown) so that the device 23 can communicate electrically with the other device or devices through the electrical cable 15.

Still referring to FIG. 2, the connector assembly 9 comprises a male connector 10, a female connector 20, and a locking system. While the male and female connectors 10 and 20 of the connector assembly 9 are illustrated as conventional male female connectors of the type widely used to make a serial cable connection to a desktop or laptop personal computer, this should be taken as exemplary and not as limiting. The disclosed locking system is equally usable with other types of connector assemblies. In addition, the disclosed locking system is not limited to connecting a male (or female) connector located on one end of a cable to a female (or male) connector mounted in a chassis as shown in FIG. 2. The locking system is also employable in other environments, such as joining male and female connectors, both connected to ends of cables that are, in turn, connected to other cables and/or devices.

Figure 1:
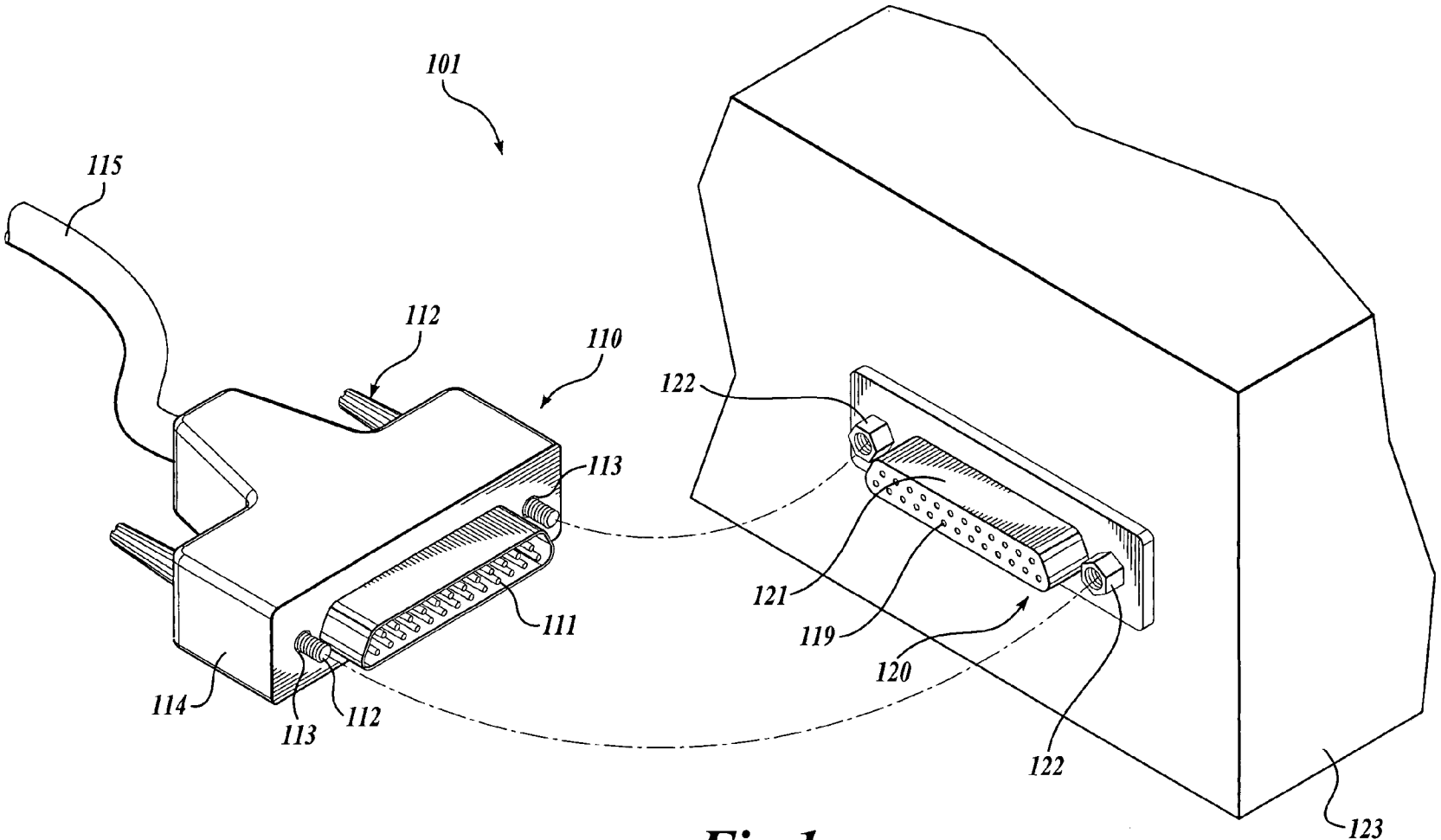
Fig. 1. (PRIOR ART)
FIG. 1 is an exploded view of a prior art connector assembly employing a thumbscrew and jack-socket locking system.

Similar to the standard electrical connector assembly illustrated in FIG. 1 and described above, the male connector 10 of the connector assembly 9 illustrated in FIG. 2 includes a plurality of male elements 11 disposed within a housing 14 that are internally connected to the wires of the electrical cable 15. As is conventional with serial connectors, the male elements 11 extend from a face of the housing 14 of the male connector 10 and are surrounded by a shield 12. While the male and female connectors 10 and 20 shown in FIG. 2 are shown as multi-pin connectors, such as a standard serial port connector, as noted above, the connectors can be any type of electrical plug connector assembly and can take on any one of a variety of forms in which male and female connectors selectively engage one another. Further, the male and female roles of the connectors illustrated in FIG. 2 can be reversed. Hence, as noted above, FIG. 2 should be considered as exemplary and not as limiting.

Figure 3:
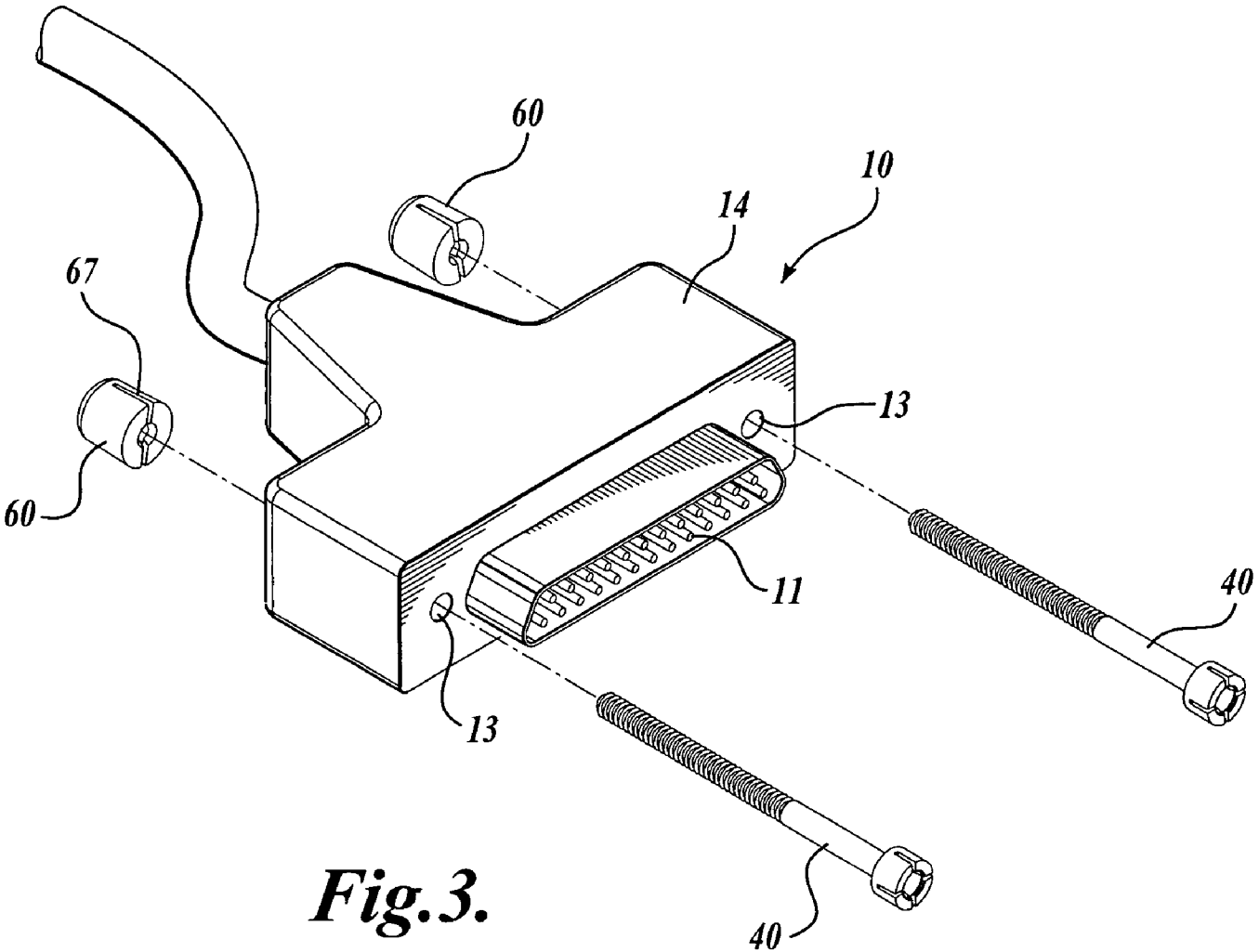
FIG. 3 is an exploded view of the male connector of the connector assembly shown in FIG. 2.

As best illustrated in FIG. 3, a pair of holes 13 is disposed in the housing 14 of the male connector 10, one on either side of the male elements 11. The axes of the holes lie parallel to the axes of the male elements 11, which is the same as the direction in which the male connector 10 slidably engages the female connector 20 in FIG. 2. The holes 13 pass through the housing 14 and are sized to accept the neck 47 of a socket fitting 40, illustrated in FIG. 3 and more fully described below.

Also, similar to the standard electrical connector assembly illustrated in FIG. 1 and described above, the female connector 20 of the presently described exemplary embodiment comprises female elements 19 located in a housing mounted in a device 23. As previously described, the device 23 can be a computing device, such as a desktop or laptop computer (PC), a peripheral device, such as a monitor or a printer, or any electronic component. The female connector 20 extends beyond a face of the chassis of the device 23 to allow the female connector 20 to slidably engage the male connector 10 to thereby electrically connect the two together.

A pair of holes (not illustrated) are located in the housing 21 of the female connector 20, one on either side of the female elements 19. The axes of the holes lie parallel to the axes of the female elements 19, which is the same as the general direction in which the male connector 10 slidably engages the female connector 20. Each hole has internal threads that threadably engage a stud 30 illustrated in FIG. 7 and more fully described below. The holes and threads are preferably sized and located similar to the holes that threadably receive the jack-sockets of the female connector illustrated in FIG. 1 and described above. In a replacement environment, described below, the threaded holes are the same as those that receive the jack-sockets.

Although the locking system described herein comprises two socket fittings 40; two socket fitting retainers 60, and two studs 30, this number should be construed as exemplary and not as limiting. Although most locking systems will likely comprise two of each of these components, more or less can be used if desired.

Figure 4:
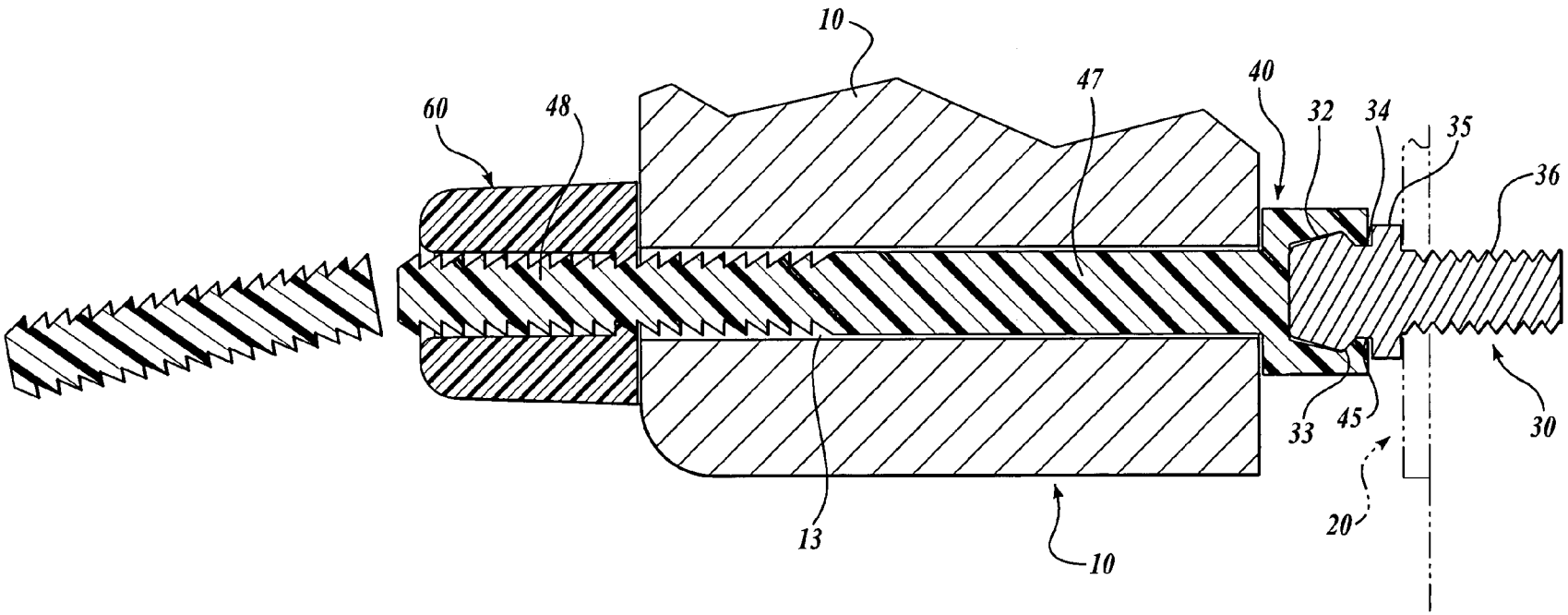
FIG. 4 is a cross-sectional view of the connector assembly shown in FIG. 2 taken through the center of one of the locking assemblies.
Figure 5:
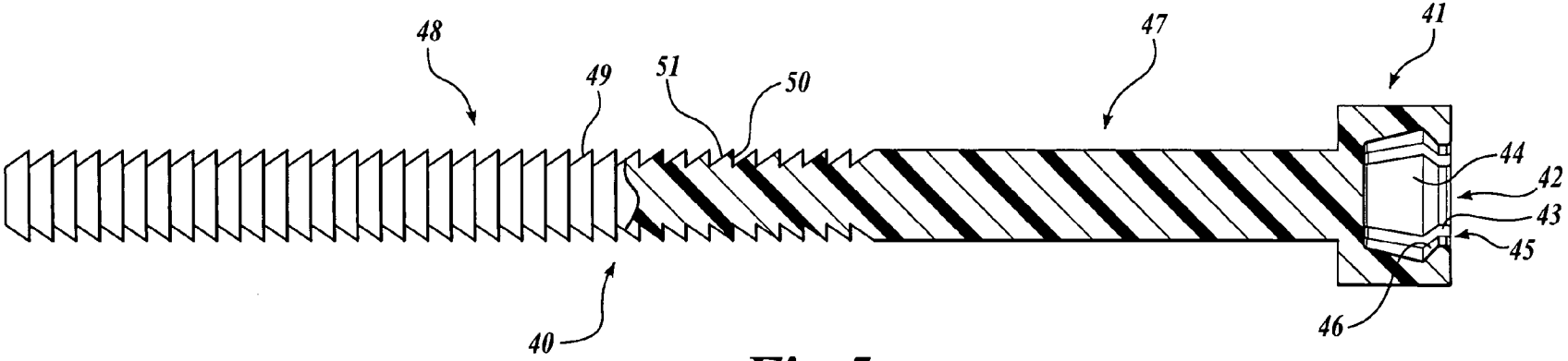
FIG. 5 is a longitudinal view, partially in cross-section taken through the center axis, of the socket fitting shown in FIG. 2.

Referring to FIGS. 4 and 5, each socket fitting 40 is elongate and comprises a socket 41 and a ribbed tail 48 located at opposite ends of a neck 47, all integrally formed with one another. While the socket fitting 40 is preferably made from a polymeric material, any suitable material, including metal, may be used.

As best shown in FIG. 5, a cylindrical, inwardly tapering cavity 44 is disposed within the socket 41. An aperture 42, located opposite the neck 47, provides access to the cavity 44. The aperture 42 is formed by one or more elements 45 that project radially inward from the outer edge of the cavity 44 such that the diameter of the aperture 42 is smaller than the outer diameter of the cavity 44. The interior sides of the projecting elements 45 have a tapered surface 46 that tapers radially outward as the surface progresses away from the aperture 42. A plurality of slots 43, shown best in FIG. 2, separate the inwardly projecting elements 45. More specifically, the slots radiate outwardly from the aperture 42, separating the projecting elements 45. The slots 43 reduce the force required to dilate the aperture 42 when a stud 30 is pushed into an aperture 42 in the manner herein described.

The neck 47 is sized to be received by a hole 13 in the male connector 10. Although the hole 13 is preferably cylindrical, it can be of other suitable shapes. Accordingly, the neck 47 can be of any size or cross-section suitable for passing through the hole 13 in the male connector 10. As shown in FIG. 4, the length of the neck 47 is less than the length of the hole 13.

The ribbed tail 48 comprises a plurality of ribs 49 extending radially from the centerline of the socket fitting 40. The ribs have the shape of truncated circular pyramids. Thus, each rib 49 has a first surface 50 that lies perpendicular to the longitudinal axis of the ribbed tail and a second surface 51 that lies at an acute angle with respect to the longitudinal axis of the ribbed tail. The second surface 51 tapers away from the socket 41, toward the centerline of the socket fitting 40. The plurality of ribs 49 are located in seriatim, i.e., one after the other, along the length of the ribbed tail 48.

Referring to FIG. 4, the socket fittings 40 are secured to the male connector by socket fitting retainers 60. While each socking fitting retainer 60 is preferably made from a polymeric material, any material, including metal, with suitable elastic properties may be used.

Figure 6:
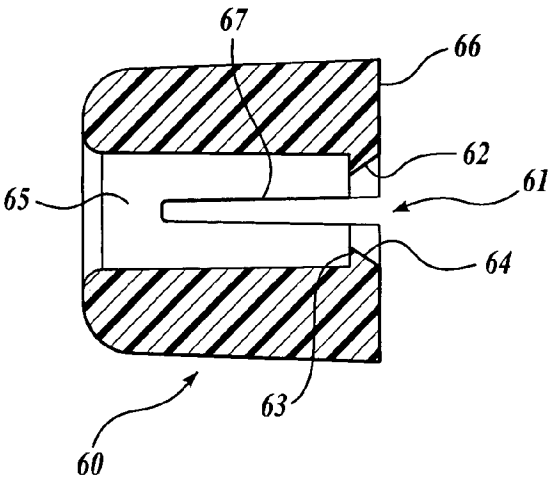
FIG. 6 is a cross-sectional view taken through the center axis of the socket fitting retainer shown in FIG. 2.

As shown in FIG. 6, each socket fitting retainer 60 has a hole 65 sized to receive the ribbed tail 48 of a socket fitting 40. A radial protrusion 62 extends inwardly from the surface of one end of the hole 65. The protrusion 62 has two surfaces. One surface 63 is internal to the hole 65 and extends inward in a direction generally perpendicular to the centerline of the hole 65. The other surface 64 of the protrusion 62 is tapered, extending inward and towards the interior of the socket fitting retainer 60 from the adjacent outer face 66 of the socket filling retainer 60.

An aperture 61 is defined by the intersection of the first surface 63 and the second surface 64. The aperture 61 has a diameter smaller than the diameter of the hole 65. As shown in FIGS. 3 and 6, two diametrically opposed slots are provided in the socket fitting retainer 60, each extending from the outer face 66 of the hole in an axial direction through at least the radial protrusion 62. The slots 67 reduce the force required to dilate the aperture 61 when the ribbed tail 48 of a socket fitting 40 is pushed into the aperture 61. While two slots 67 are illustrated, this number should be taken as exemplary and not limiting. The size, number, and location of the slots may vary depending on the material properties of the socket fitting retainer.

Referring to FIG. 3, the socket fittings 40 are inserted into the holes 13 in the male connector 10 so that the socket 41 portion is proximate to the male elements 11 and the ribbed tail 48 extends from the opposite side of the male connector 10. Each socket fitting 40 is secured to the male connector 10 with a socket fitting retainer 60. Each socket fitting retainer 60 is axially aligned with its respective socket fitting 40 and pressed against the end of the ribbed tail of the socket fitting 40 so that the aperture 61 of the socket fitting retainer 60 engages the ribbed tail 48 of the socket fitting 40. As pressure is applied, the tapered surface 51 of the rib 49 on the ribbed tail 48 presses against the tapered surface 64 of the protrusion 62 of the socket fitting retainer 60 causing the aperture 61 of the socket fitting retainer 60 to dilate, thereby allowing the rib 49 to pass through the aperture 61. After a rib 49 has passed through the aperture 61, the elastic properties of the socket fitting retainer 60 cause the socket fitting retainer 60 to return to its original shape. If pressure is applied in this opposite direction, the perpendicular surface 50 of the rib then engages the perpendicular surface 63 of the protrusion 62 on the socket fitting retainer 60 to prevent the socket fitting retainer 60 from disengaging from the ribbed tail 48 of the socket fitting 40.

The socket fitting retainers 60 are slid onto the ribbed tail 48, passing over additional ribs 49 in seriatim, until the socket fitting retainers 60 and the socket 41 portion of the socket fittings 40 are both in contact with the housing 14 of the male connector 10. As a result, the socket fitting retainers 60 restrain the socket fittings 40 axially, thereby preventing the socket fittings 40 from disengaging from the holes 13 in the male connector 10. As shown in FIG. 4, if desired, the portion of the ribbed tails 48 extending beyond the ends of the socket fitting retainers 60 can be removed.

Although the above-described sockets 41 are illustrated as integral to the socket fittings 40 and are secured to the male connector 10 with socket fitting retainers 60, this should be taken as exemplary and not limiting. The sockets can be attached to the male connectors in other suitable manners. For example, the socket fittings may include a threaded tail suitable for threadably engaging internal threads in holes in the male connector 10. The socket fittings can also be secured in the male connector 10 with rivets or with an adhesive. In yet other alternative embodiments, the sockets may be integrally formed with the housing 14 of the male connector 10. In still other alternative embodiments, one or more of the sockets 41 may include a threaded tail sized to threadably couple the socket 41 to a threaded hole in one of the male and female connectors.

Figure 7:
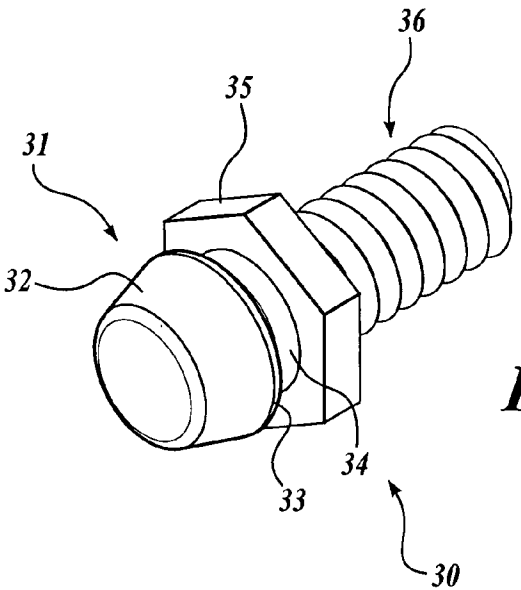
FIG. 7 is an isometric view of the stud shown in FIG. 2.

The studs 30 are preferably made from a metal, although any material having suitable hardness and durability, such as nylon, may be used. Referring to FIG. 7, one end of each of the studs 30 includes a lock portion 31. The other end includes a threaded tail 36. The lock portion 31 has a diameter sized sufficiently large so as to not pass through the aperture 42 of the socket 41 of a socket fitting 40 when the socket 41 is in an undilated state. More specifically, the outer end of the lock portion 31 has the shape of a truncated cone that defines a front tapered surface 32 that extends radially outward, toward the threaded tail 36, and a back tapered surface 33 that extends radially inward, toward the threaded tail 36. A hexagonal plate 35, disposed between the lock portion 31 and the threaded tail 36, lies perpendicular to the centerline of the stud 30. A circumferential groove 34 separates the lock portion 31 from the hexagonal plate 35. As illustrated, the lock portion 31, the threaded tail 36, the hexagonal plate 35, and the circumferential groove of each stud are all integral with one another.

The threaded tail 36 of each stud 30 is sized to threadably couple the stud 30 to a threaded hole in the female connector 20 described above. More specifically, in the exemplary embodiment described herein, each threaded tail 36 is preferably sized so that the stud 30 can be threadably coupled to the hole in a standard electrical connector assembly that normally receives a jack-socket. While the presently described embodiment of the stud 30 is threadably engaged with the second connector 20, it is to be understood that such engagement is exemplary and should not be construed as limiting since the stud 30 can be attached to the female connector 20 in any suitable manner as long as the lock portion 31 of the stud 30 remains accessible to the socket 41. For example, each stud may be disposed on one end of an elongate stud fitting, similar to the socket fittings 40 described above, and secured to one of the male and female connectors with a stud fitting retainer, similar to the above-described socket fitting retainers 60.

An electrical connection is achieved by slidably engaging the male connector 10 and the female connector 20. As the male elements 11 engage the female elements 19, pressure applied to the sockets 41 of the socket fittings 40 snap the sockets onto the lock portion 31 of the studs 30, thereby locking the male connector 10 to the female connector 20. More specifically, as the male connector 10 engages the female connector 20, the studs 10 become axially aligned with the apertures 42 of the socket fittings 40. When aligned, the front tapered surfaces 32 of the studs 30 contact the projecting elements 45 of the sockets 41. As the male connector 10 is pushed to engage the female connector 20, the front tapered surfaces 32 of the studs 30 press against the projecting elements 45, dilating the apertures 42 until the locking portions 31 of the studs 30 pass through the apertures 42. After the locking portions 31 of the studs 30 have passed through the apertures 42, the elastic properties of the socket fittings 40 cause the apertures 42 to return to their original size. As shown in FIG. 4, the projecting elements 45 are contained by the circumferential grooves 34. When an unintentional disengaging force is applied to the male connector 10, the contact between the rear tapered surfaces 33 of the studs 30 and the projecting elements 45 of the sockets 41 resists disengagement. Further, as shown in FIG. 4, the front tapered surfaces 32 of the studs 30 have a more gradual taper than the rear tapered surfaces 33 of the studs 30. As a result, less force is required to engage a stud 30 with a socket 41 than to disengage a stud 30 from a socket 41.

To disengage the male connector 10 from the female connector 20, a user applies a slight lateral force to the male connector 10 while pulling the male connector 10 away from the female connector 20. The lateral force breaks the grip of the socket fittings 40 on the studs 30, thereby allowing the male connector 10 to be completely disengaged from the female connector 20. More specifically, pulling on the male connector 10 causes the contact between the rear tapered surfaces 33 of the studs 30 to contact the projecting elements 45 of the sockets 41 to dilate the apertures 42 of the sockets 41 until the locking portions 31 of the studs 30 pass through the apertures 42. The lateral force further dilates the apertures 42, decreasing the axial force required to disengage at least one of the studs 30 from the sockets 41'.

As will be readily appreciated, if desired, the locking system of a standard electrical connector assembly (FIG. 1) can be replaced with the locking system described herein. This is accomplished by removing the thumbscrews 112 from the holes 113 in the male connector 110 and unscrewing the jack-sockets 122 from the female connector 120. Then a socket fitting 40 (FIG. 3) is inserted into each hole 113 in the male connector such that the socket 41 portion is proximate to the male elements 111. Each socket fitting 40 is secured to the male connector 110 by sliding a socket fitting retainer 60, aperture 61 first, over the ribbed tail 48 of the socket fitting 40 that protrudes beyond the housing 114 of the male connector 110. Each socket fitting retainer 60 is slid along the ribbed tail 48 of the socket fitting 40 until both the socket portion 41 of the socket fitting 40 and the socket fitting retainer 60 are both securely in contact with the housing 114 of the male connector 110. If desired, as shown in FIG. 4, the portion of the ribbed tail 48 portion of the socket fitting 40 that extends beyond the socket fitting retainer 60 can optionally be trimmed off. Next, a stud 30 is threaded into each threaded hole in the female connector 120, thereby completing the replacement of the locking system of a standard electrical connector assembly with the exemplary embodiment described herein.

While illustrative embodiments have been illustrated and described, it will be appreciated that various changes can be made therein without departing from the spirit and scope of the invention, some of which are described above.

The embodiments of the invention in which an exclusive property or privilege is claimed are defined as follows:

1. An electrical connector assembly including a pair of electrical connectors and a locking system for locking together the pair of electrical connectors, the locking system comprising:

(a) a stud forming part of one of the pair of electrical connectors, the stud including a lock portion; and (b) a monolithic socket forming part of the other of the pair of electrical connectors, the socket comprising:

(i) a cavity, and (ii) an aperture for providing access to the cavity, the aperture being sized smaller than the lock portion of the stud, the aperture being formed so as to temporarily dilate to allow the lock portion of the stud to pass through the aperture into the cavity of the socket and resume its original shape after the lock portion lies within the cavity, wherein the lock portion of the stud lockingly engages the socket when the stud and the socket are lockingly engaged.

2. The electrical connector assembly of claim 1, wherein the stud also includes a threaded tail.

3. The electrical connector assembly of claim 2, wherein the threaded tail affixedly attaches the stud to said other of said pair of connectors.

4. The electrical connector assembly of claim 1, wherein the lock portion is cylindrical and includes a truncated cone portion that tapers both outwardly and inwardly toward the axis of the stud.

5. The electrical assembly of claim 1, wherein the socket is located at one end of an elongate socket fitting.

6. The electrical connector assembly of claim 5, wherein the socket fitting includes a plurality of ribs in seriatim at the end remote from the socket.

7. The electrical connector assembly of claim 6, also including a socket fitting retainer mounted on the plurality of ribs of the socket fitting so as to attach the socket fitting and, thus, the socket to said one of said pair of electrical connectors.

8. In an electrical connector assembly comprising a male electrical connector and a female electrical connector, a locking system for locking the male electrical connector to the female electrical connector, the locking system comprising:

a pair of studs attached to one of said male and female electrical connectors, each of the studs including a lock portion; and a pair of monolithic sockets attached to the other of said male and female electrical connectors, each socket comprising:

(a) a cavity; and (b) an aperture for providing access to the cavity, the aperture being sized smaller than the lock portion of the stud, the aperture being formed so as to temporarily dilate to allow the lock portion of the stud to pass through the aperture into the cavity of the socket and resume its original shape after the lock portion lies within the cavity, wherein said sockets and said studs are sized, shaped and positioned such that the lock portion of each stud lockingly engages a corresponding one of the sockets when said male and said female electrical connectors are connected together.

9. The electrical connector assembly of claim 8, wherein the male and female electrical connectors each includes a plurality of electrical connecting elements.

10. The electrical connector assembly of claim 8, wherein each of the studs also includes a threaded tail.

11. The electrical connector assembly of claim 10, wherein the threaded tails of said studs affixedly attach the studs to said other of said male and female electrical connectors.

12. The electrical connector assembly of claim 8, wherein the lock portions of said studs are cylindrical and include a truncated cone portion that tapers both outwardly and inwardly toward the axis of the stud.

13. The electrical connector assembly of claim 8, wherein each of the sockets is located at one end of an elongate socket fitting.

14. The electrical connector assembly of claim 13, wherein each of the socket fittings includes a plurality of ribs in seriatim at the end remote from the socket.

15. The electrical connector assembly of claim 14, also including two socket fitting retainers, one of said socket fitting retainers mounted on the plurality of ribs of one of the socket fittings so as attach the socket fittings and, thus, the sockets to said one of said male and female electrical connectors.

16. The electrical connector assembly of claim 8, the locking system further comprising:

two stud fitting retainers, wherein each of the sockets includes a threaded tail to affixedly attach the sockets to said one of said male and female electrical connectors, and each of the studs is located at one end of an elongate stud fitting, each of said stud fittings including a plurality of ribs in seriatim at the end remote from the stud, and one of said stud fitting retainers mounted on the plurality of ribs of one of the stud fittings so as to attach the stud fittings and, thus, the studs to said other of said male and female electrical connectors.

* * * * *

UNITED STATES PATENT AND TRADEMARK OFFICE

CERTIFICATE OF CORRECTION

PATENT NO. : 7,374,448 B2
APPLICATION NO. : 11/592378
DATED : May 20, 2008
INVENTOR(S) : D. L. Jepsen et al.

It is certified that error appears in the above-identified patent and that said Letters Patent is hereby corrected as shown below:

| ITEM | | ERROR |
|---|---|---|
| (75) | Inventors | "David L Jepsen," should read --David L. Jepsen,-- |
| (75) | Inventors | "Richard A Villarreal," should read --Richard A. Villarreal,-- |
| (65) | Prior Publication Data | Insert in appropriate order --(65) Prior Publication Data US 2008/0108244 A1 May 8, 2008-- |
| (10) | Patent No. | "**B1**" should read --**B2**-- |
| (57) | Abstract 8 of text | "electrical by ribs," should read --electrical connector by ribs,-- |

Signed and Sealed this

Twentieth Day of January, 2009

JON W. DUDAS
*Director of the United States Patent and Trademark Office*